US007616169B2

(12) United States Patent
Holter

(10) Patent No.: US 7,616,169 B2
(45) Date of Patent: Nov. 10, 2009

(54) ELECTRICALLY CONTROLLED BROADBAND GROUP ANTENNA, ANTENNA ELEMENT SUITABLE FOR INCORPORATION IN SUCH A GROUP ANTENNA, AND ANTENNA MODULE COMPRISING SEVERAL ANTENNA ELEMENTS

(75) Inventor: Henrik Holter, Farsta (SE)

(73) Assignee: SAAB AB, Linköping (SE)

( * ) Notice: Subject to any disclaimer, the term of this patent is extended or adjusted under 35 U.S.C. 154(b) by 84 days.

(21) Appl. No.: 10/520,462

(22) PCT Filed: Jun. 25, 2003

(86) PCT No.: PCT/SE03/01098

§ 371 (c)(1),
(2), (4) Date: Aug. 12, 2005

(87) PCT Pub. No.: WO2004/006388

PCT Pub. Date: Jan. 15, 2004

(65) Prior Publication Data

US 2005/0285808 A1 Dec. 29, 2005

(30) Foreign Application Priority Data

Jul. 8, 2002 (SE) ..... 0202123

(51) Int. Cl.
*H01Q 21/00* (2006.01)

(52) U.S. Cl. ..... 343/844; 343/893

(58) Field of Classification Search ..... 343/898, 343/895, 853, 773, 893, 896, 899, 785, 844
See application file for complete search history.

(56) References Cited

U.S. PATENT DOCUMENTS

| | | | | |
|---|---|---|---|---|
| 2,264,002 | A | | 11/1941 | Neracher et al. |
| 2,473,446 | A | * | 6/1949 | Riblet ..... 343/785 |
| 2,532,551 | A | * | 12/1950 | Jarvis ..... 343/774 |
| 2,624,002 | A | | 12/1952 | Bouix |
| 3,255,452 | A | | 6/1966 | Walter et al. |
| 3,255,454 | A | | 6/1966 | Walter et al. |
| 3,386,099 | A | | 5/1968 | Walter et al. |

(Continued)

FOREIGN PATENT DOCUMENTS

GB 697163 A 9/1953

(Continued)

OTHER PUBLICATIONS

Henrik Holter, Tan-Huat Chio and Daniel H. Schaubert; Experimental Results of 144-Element Dual-Polarized Endfire Tapered-Slot Phased Arrays; IEEE Transactions on Antennas and Propagation; Nov. 2000; pp. 1707-1718; vol. 48, No. 11.

*Primary Examiner*—Michael C Wimer
(74) *Attorney, Agent, or Firm*—Venable LLP; Eric J. Franklin

(57) ABSTRACT

An electrically controlled group antenna including an antenna element suitable for incorporation in such a group antenna and an antenna module including several such antenna elements. The antenna elements include a rotationally-symmetrical body tapering towards one end of the body. The rotationally-symmetrical body is provided with a metallic casing surface. Several antenna elements are arranged separately on a common earth plane. A broadband group antenna is achieved that, among other things, is simple in design and is easy to manufacture and repair.

21 Claims, 3 Drawing Sheets

U.S. PATENT DOCUMENTS 3,795,005 A * 2/1974 Monser et al. ..... 343/895
4,400,703 A * 8/1983 Shiokawa et al. ..... 343/895
4,697,192 A * 9/1987 Hofer et al. ..... 343/895
4,786,911 A * 11/1988 Svy ..... 343/785
5,258,771 A * 11/1993 Praba ..... 343/895
5,801,660 A * 9/1998 Ohtsuka et al. ..... 343/700 MS
6,043,785 A * 3/2000 Marino ..... 343/767
6,268,834 B1 * 7/2001 Josypenko ..... 343/773
6,486,846 B1 * 11/2002 Hart ..... 343/773
6,593,892 B2 * 7/2003 Honda et al. ..... 343/773

FOREIGN PATENT DOCUMENTS

JP 2003078343 A 3/2003

* cited by examiner

ELECTRICALLY CONTROLLED BROADBAND GROUP ANTENNA, ANTENNA ELEMENT SUITABLE FOR INCORPORATION IN SUCH A GROUP ANTENNA, AND ANTENNA MODULE COMPRISING SEVERAL ANTENNA ELEMENTS

CROSS-REFERENCE TO RELATED APPLICATIONS

This application claims priority to Swedish patent application 0202123-6 filed 8 Jul. 2002 and is the national phase under 35 U.S.C. § 371 of PCT/SE2003/001098.

FIELD OF THE INVENTION

Electrically controlled broadband group antenna, antenna element suitable for incorporation in such a group antenna, and antenna module comprising several antenna elements.

BACKGROUND OF THE INVENTION

The present invention relates to an electrically controlled broadband group antenna comprising a plurality of antenna elements arranged in a common plane Hand connected to a feeder unit. The invention also relates to an antenna element suitable for incorporation in an electrically controlled broadband group antenna, the antenna element comprising a rotationally-symmetrical body tapering towards one end. In addition, the invention relates to an antenna module with a plurality of such antenna elements. These group antennas preferably work with linear polarization or two orthogonal polarizations.

Electrically controlled broadband group antennas with an instantaneous bandwidth larger than one octave are a very important component in, among other things, military telecommunication systems and multifunction radar. There are currently only a few broadband antenna elements that are suitable for electrically controlled broadband group antennas. These antenna elements have a plurality of disadvantages.

A known type of broadband group antenna uses antenna elements that have the name "Tapered Slot". See, in connection with this, IEEE Transactions on Antennas and Propagation, volume 48, no. 11, November 2000, pages 1707-1718, Experimental Results of 144-Element Dual-polarized Endfire Tapered-Slot Phased Arrays. In general, for known electrically controlled broadband group antennas, it is the case that the antenna elements are complicated and their production is difficult and therefore expensive. This applies in particular for group antennas with two orthogonal polarizations. In addition, it is often difficult to connect the antenna elements to an underlying microwave unit.

With regard to group antennas with "Tapered Slot" antenna elements, we can mention in particular difficulties in achieving electrical contact between adjacent antenna elements, which is important for the electrical function. This applies, in particular, for high frequencies, as the element distance is small. For example, the element distance is only approximately 8.5 mm at a frequency of 18 GHz. Another difficulty is in connecting the antenna elements to an underlying lobe-shaping network or to underlying microwave units. In addition, there is the danger that electromagnetic resonances will arise in the antenna elements. These resonances can considerably impair the electrical characteristics of the antenna elements.

SUMMARY OF THE INVENTION

The object of the present invention is to achieve a group antenna and antenna elements that do not have the above disadvantages of known broadband group antennas. The object of the invention is achieved by means of a group antenna characterized in that each antenna element comprises a rotationally-symmetrical body arranged on an earth plane that is common to several antenna elements, with the axis of rotation of the body essentially perpendicular to the earth plane, which body, at the end furthest away from the earth plane, is shaped so that it tapers inwards with increasing distance from the earth plane and is provided with a metallic casing surface. Antenna elements suitable for incorporation in the group antenna are characterized in that the rotationally-symmetrical body is provided with a metallic casing surface.

By means of the invention, a group antenna and antenna elements are achieved that are simple and cheap to produce. The installation of the antenna elements is simple and the adjacent antenna elements do not need to be welded together. The antenna elements consist of metal. In this way, the problems are avoided that are associated with dielectric substrates that are normally used in group antennas. Problems that are associated with dielectric substrates include losses, surface waves and resonances.

According to an advantageous embodiment, the earth plane of the group antenna is provided with recesses in the forms of slots that separate the antenna elements from each other and function electrically as open circuits. By means of the introduction of these slots in the earth plane, separation of the antenna elements has been achieved in a simple way, while at the same time the production of the slots only requires simple manufacturing technology and can be carried out, for example, by milling.

According to another advantageous embodiment of the group antenna according to the invention, the antenna elements are connected to the earth plane by means of a connection that can be broken, such as a screw connection. The antenna elements are characterized in that the other end of the body comprises means for attaching the body in such a way that it can be removed, and the means for attaching the body in such a way that it can be removed comprise, according to one embodiment, one part of a screw connection. The embodiment allows the antenna elements to be removed easily, which facilitates the replacement of defective antenna elements. Instead of scrapping a whole module of antenna elements, in the most favourable cases it is sufficient to unscrew and replace a single antenna element. As a result of the antenna element's symmetrical shape, the installation is made easier, as the antenna element can be screwed on in any rotational position.

According to yet another advantageous embodiment, a spacing sleeve is incorporated in each antenna element at the transition between the rotationally-symmetrical body and the earth plane. The spacing sleeve is suitably provided with at least one cable bush with a first opening aligned in the radial direction of the spacing sleeve and a second opening aligned parallel with the axis of symmetry of the body and the sleeve. The incorporation of a spacing sleeve facilitates the attachment of the antenna elements to a lobe-shaping network or microwave units lying under the earth plane. At the same time as the rotationally-symmetrical body of the antenna element is installed on the earth plane by means of a rotational movement, the cables incorporated and the spacing sleeve can be held fixed relative to the earth plane.

According to yet another advantageous embodiment, the earth plane is provided with two cable bushes for each antenna element, which are each allocated a double-conductor, for example a coaxial cable, one conductor of which is attached to the antenna element and the other conductor of which is attached to an adjacent antenna element. The arrangement of cable bushes and the method of attaching the cables gives the group antenna a logical construction and contributes to the simple attachment of the antenna to a feeder unit, such as a number of microwave units. The antenna according to the invention makes possible a close connection to microwave units and, according to an embodiment, the feeder unit comprises one or more microwave units that form the antenna elements' common earth plane. By this means, power losses that arise in coaxial contacts and connection contacts are reduced, while at the same time the costs of coaxial contacts and coaxial cables disappear or are considerably reduced. In addition, a close connection to the microwave units saves space.

The antenna elements can be placed in a number of different grid configurations. Two attractive grid configurations in this connection can be the rectangular grid or the triangular grid.

According to a suitable dimensioning of the group antenna, two adjacent antenna elements are arranged with a distance between centres of essentially half a wavelength for the highest working frequency of the group antenna. This gives the group antenna an optimal compact form without making the antenna more complex in its design.

The rotationally-symmetrical body of the antenna element can be given a number of different forms, such as for example a circular paraboloid or a conical shape.

According to one embodiment, the rotationally-symmetrical body of the antenna element consists principally of aluminium. The choice of aluminium as conductor gives the antenna element a low weight. Another embodiment of the antenna element according to the invention that keeps down the weight is to make the rotationally-symmetrical body hollow.

A stable and easily manufactured antenna element according to the invention is characterized in that the rotationally-symmetrical body consists of an homogenous metallic material. The antenna element can be manufactured by turning and the homogeneity contributes to the stability of the antenna element.

A group antenna according to the invention can be constructed of antenna modules, with each module comprising a plurality of antenna elements.

BRIEF DESCRIPTION OF THE DRAWINGS

The invention will be described below with reference to the attached drawings in which.

DETAILED DESCRIPTION OF PREFERRED EMBODIMENTS

Figure 1:
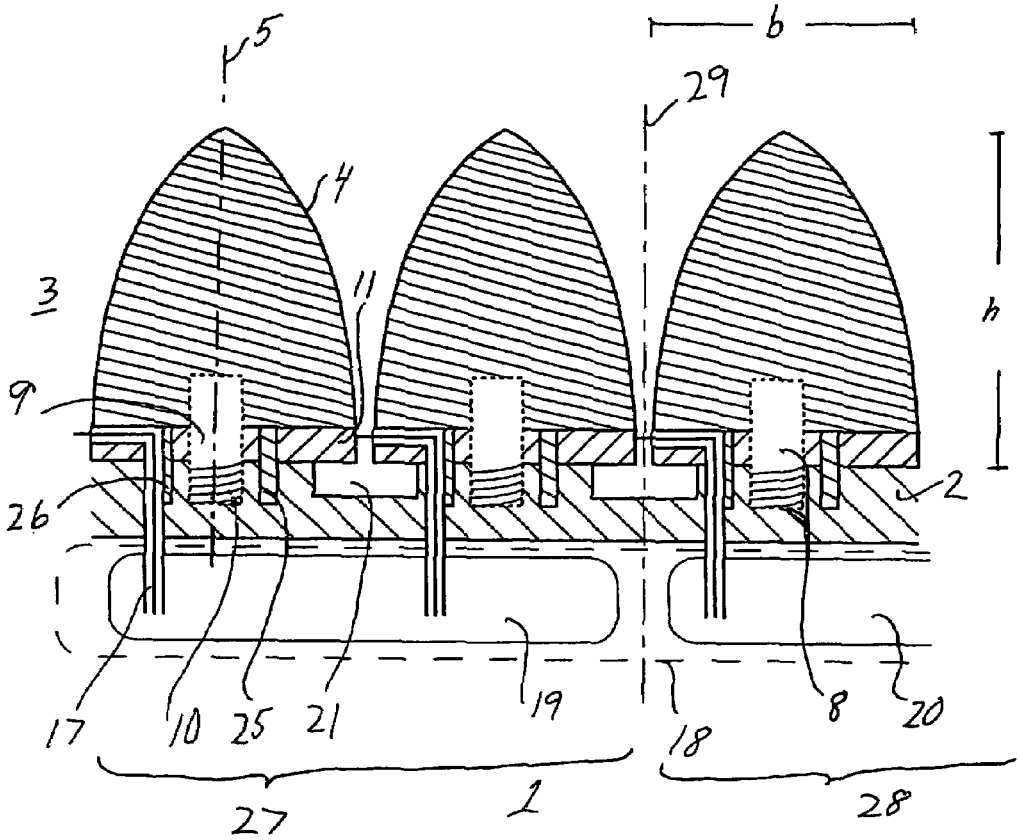
FIG. 1 shows schematically according to the section 1A-1A in FIG. 2 a sectioned side view of a part of a group antenna according to an embodiment.
Figure 2:
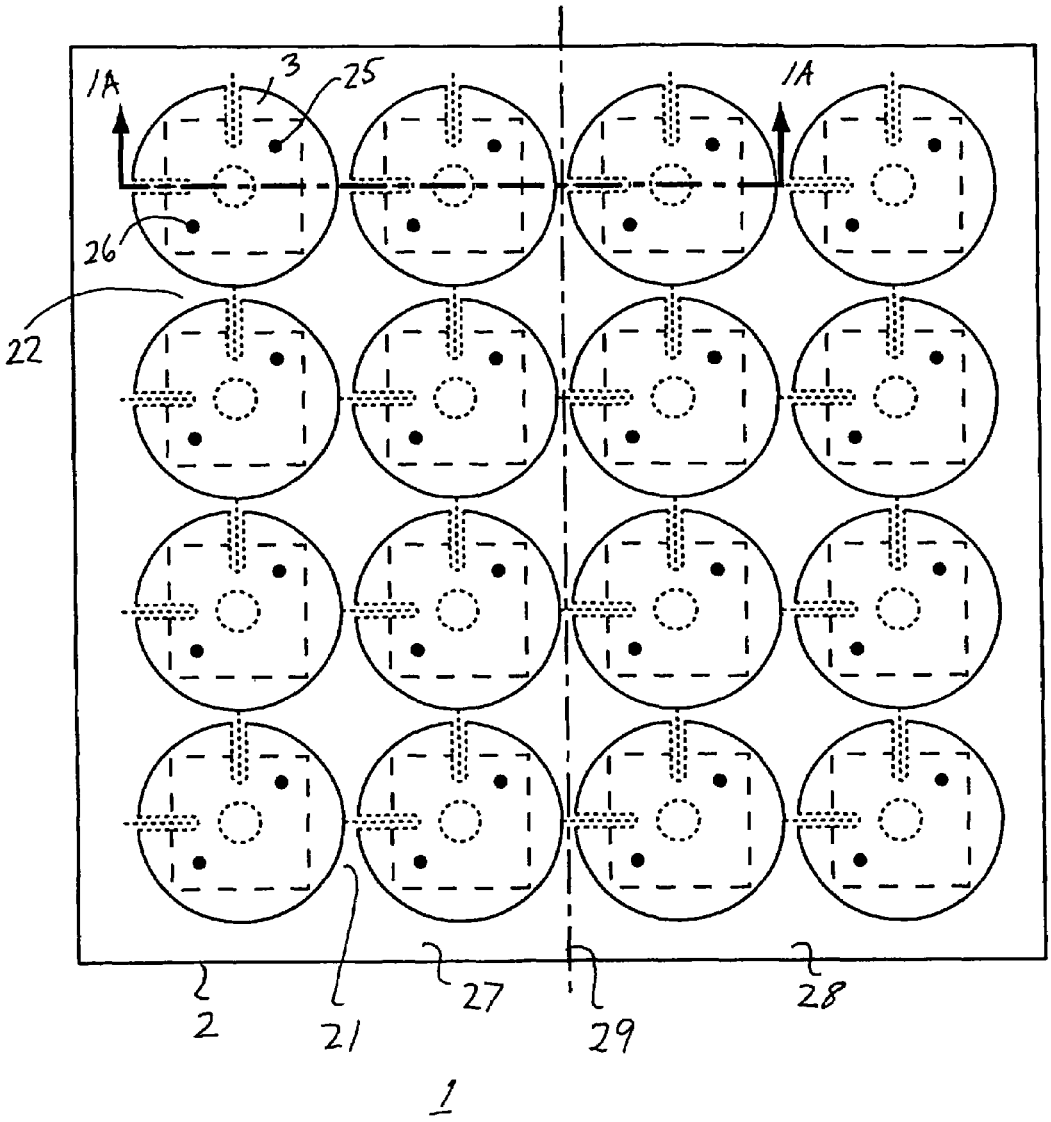
FIG. 2 shows a schematic top view of an embodiment of a group antenna according to the invention.

The group antenna 1 shown in FIGS. 1 and 2 comprises an earth plane or an earth plate 2 on which the antenna elements 3 are arranged. The antenna elements comprise a rotationally-symmetrical body 4 with an axis of symmetry 5. The ratio between the height h and the breadth b of an incorporated antenna element can vary, but lies preferably within a range between the ratio 1:1 and the ratio 6:1.

Figure 3A:
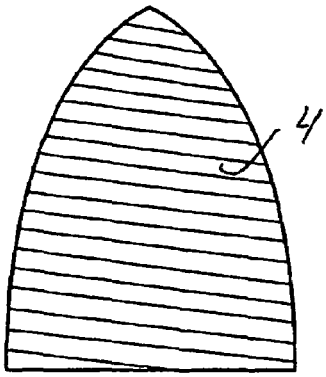
FIGS. 3*a*-3*c* show in section through the centre of rotation three different examples of embodiments of a rotationally-symmetrical body comprised in an antenna element according to the invention.
Figure 3B:
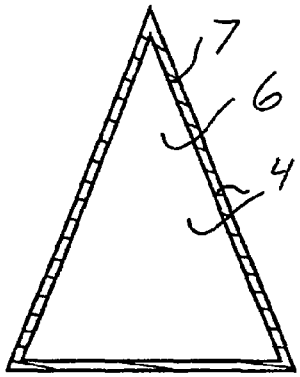
Figure 3C:
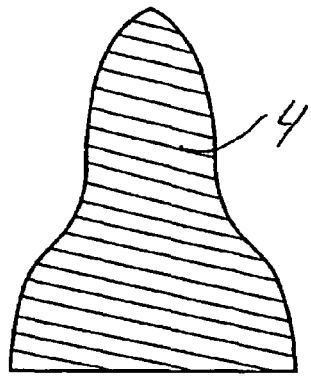

FIG. 3 shows three examples of how the symmetrical body can be designed. The body shown in FIG. 3*a* is a circular paraboloid and is constructed of homogenous metallic material. The body according to FIG. 3*b* is a hollow conical shape with a cavity 6 surrounded by a metallic casing 7. A third more varied shape is shown in FIG. 3*c*. The body is shown here homogeneous, but can also be constructed with a cavity. In a more extreme embodiment, the body can even be shaped so that it does not taper continuously, but can have a flaring midsection. The metallic material can consist of aluminium, stainless steel or other suitable conductive metallic material. The symmetrical bodies of the antenna elements covered with metallic material constitute the radiating elements of the antenna.

Figure 4:
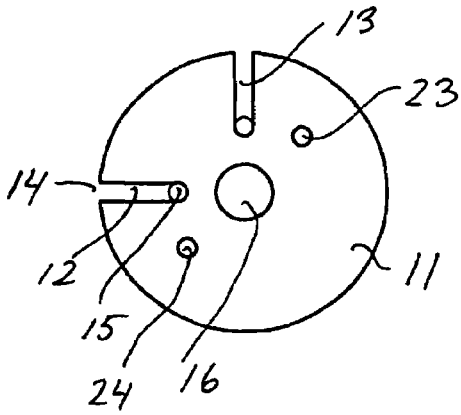
FIG. 4 shows in top view an example of a spacing sleeve that can be incorporated in the antenna element according to the invention.

As shown best in FIG. 1, a screw connection 8 is arranged to connect the rotationally-symmetrical body 4 to the earth plane 2. In the example shown, the screw connection consists of a projecting threaded pin 9 permanently attached to the rotationally-symmetrical body or alternatively constructed in one piece with the body. The threaded pin 9 engages with a threaded hole 10 formed in the earth plane 2. A spacing sleeve 11, see FIG. 4, is arranged between the rotationally-symmetrical body 4 and the earth plane 2. The spacing sleeve 11 is provided with two cable bushes 12 and 13 with an opening 14 in the radial direction of the spacing sleeve and an opening 15 in the axial direction. In the centre of the spacing sleeve, there is a hole 16 dimensioned to take the pin 9. In addition to the hole 16, the spacing sleeve is provided with two further holes 23, 24 to engage with pins 25, 26 projecting from the earth plane 2.

For installing an antenna element, the spacing sleeve 11 is put in place centrally over the threaded hole 10. In addition, the requisite cables 17 are put in place. Thereafter, the rotationally-symmetrical body 4 with the threaded pin 9 is screwed tight onto the earth plane 2 with the spacing sleeve between. The spacing sleeve 11 is held fixed relative to the earth plane 2 while the body 4 is screwed tight. At a suitable moment, the screwing movement is discontinued. As the body 4 is rotationally symmetrical, the rotational position of the body has no effect on the function of the antenna. In the embodiment shown here, the spacing sleeve 11 is fixed relative to the earth plane 2 by the interaction between the projecting pins 25, 26 on the earth plate and holes 23, 24 in the spacing sleeve 11. Other solutions are possible within the framework of the invention.

Slots 21, 22 are arranged in the earth plane 2. In combination, these slots form channels around each antenna element 3. In the example shown in FIG. 2, the channel network is constructed of five parallel slots 22 that are intersected at right angles by five parallel slots 21. The electrical function of the slots is to act as an open circuit.

As indicated by broken lines in FIG. 1, a feeder unit is arranged in association with the underside of the earth plane 2. The feeder unit has been given the reference numeral 18 and can consist of a plurality of microwave units 19, 20, each of which serves a plurality of antenna elements via cables 17. By arranging the microwave units directly in contact with the earth plane 2, the simplest possible connection of the antenna units 3 is obtained with short cable runs and few or no joints. It is also possible to design the feeder unit consisting of microwave units in such a way that the microwave units form the earth plane 2 of the group antenna.

The group antenna is suitable for modular construction and, in the embodiment described above, comprises two modules 27 and 28. A broken line 29 marks the interface between the modules 27 and 28. When the group antenna is constructed of adjacent modules in this way, with each module comprising a number of antenna elements 3, a joint is needed between adjacent modules. This joint is located suitably centrally in a slot, and in FIGS. 1 and 2 is located in one of the slots 21 according to the broken line 29. A location of the joint centrally in a slot is favourable as the electrical surface currents are weak at the bottom of the slot. By this means, no strong current paths are cut.

The invention is not limited to the embodiments described above as examples, but can be modified within the framework of the following patent claims.

The invention claimed is:

1. An electrically controlled broadband group antenna, comprising:

a plurality of antenna radiating elements arranged in a common plane, each antenna radiating element comprising a body arranged on a ground plane that is common to several of the antenna radiating elements, each body comprising a rotationally-symmetrical surface having an axis of rotation substantially perpendicular to the ground plane, the surface of each body having a shape that tapers toward the axis of rotation with increasing distance from the ground plane, the surface of each body being entirely covered with a metallic casing; and a feeder unit operatively connected to the antenna radiating elements.

2. The group antenna according to claim 1, wherein the ground plane comprises recesses that separate the antenna radiating elements from each other and function electrically as open circuits.

3. The group antenna according to claim 2, wherein the recesses comprise slots.

4. The group antenna according to claim 1, wherein the antenna radiating elements are connected to the ground plane with a breakable connection.

5. The ground antenna according to claim 4, wherein the breakable connection comprises a screw connection.

6. The group antenna according to claim 1, further comprising:

a spacing sleeve arranged at a transition between each rotationally-symmetrical body and the ground plane.

7. The group antenna according to claim 1, further comprising:

two cable bushes arranged in the ground plane for each antenna radiating element; and a double-conductor arranged in each cable bush, a first of the double-conductors being attached to the antenna radiating element and a second of the double-conductors being attached to an adjacent antenna radiating element.

8. The group antenna according to claim 7, wherein each double-conductor comprises a coaxial cable.

9. The group antenna according to claim 1, wherein the antenna radiating elements are arranged in a rectangular grid.

10. The group antenna according to claim 1, wherein the antenna radiating elements are arranged in a triangular grid.

11. The group antenna according to claim 6, further comprising:

two cable bushes arranged in each spacing sleeve.

12. The group antenna according to claim 1, wherein centers of adjacent antenna radiating elements are arranged at a distance of substantially half a wavelength for a highest working frequency of the group antenna.

13. The group antenna according to claim 1, wherein the feeder unit comprises one or more microwave units that form the common ground plane.

14. The group antenna according to claim 1, wherein a second end of each body comprises means for removably attaching the body to the ground plane.

15. The group antenna according to claim 14, wherein the means for removably attaching the body comprises part of a screw connection.

16. The group antenna according to claim 1, wherein the rotationally-symmetrical surface is substantially conical.

17. The group antenna according to claim 1, wherein the rotationally-symmetrical is substantially a circular paraboloid.

18. The group antenna according to claim 1, wherein the body comprises aluminum.

19. The group antenna according to claim 1, wherein the body is hollow.

20. The group antenna according to claim 1, wherein the body comprises a homogenous metallic material.

21. The group antenna according to claim 6, wherein the spacing sleeve comprises at least one cable bush including a first opening aligned in a radial direction of the spacing sleeve and a second opening aligned parallel with an axis of symmetry of the surface and the sleeve.

* * * * *

UNITED STATES PATENT AND TRADEMARK OFFICE

CERTIFICATE OF CORRECTION

PATENT NO. : 7,616,169 B2
APPLICATION NO. : 10/520462
DATED : November 10, 2009
INVENTOR(S) : Henrik Holter It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 157 days.

Signed and Sealed this

Nineteenth Day of October, 2010

David J. Kappos

David J. Kappos
*Director of the United States Patent and Trademark Office*